United States Patent [19]

Clement et al.

[11] 4,020,407

[45] Apr. 26, 1977

[54] CONTROL SYSTEM FOR TRACKING A MOVING TARGET

[75] Inventors: Gilbert L. Clement, Seneac; Rene F. Buttman, Soues, both of France

[73] Assignee: Etat Francais, France

[22] Filed: Apr. 15, 1974

[21] Appl. No.: 460,997

Related U.S. Application Data

[63] Continuation-in-part of Ser. No. 337,572, March 2, 1973, Pat. No. 3,840,794.

[52] U.S. Cl. ..... 318/632; 318/632; 318/675; 89/41 B

[51] Int. Cl.[2] ..... G05B 19/29

[58] Field of Search ..... 235/61.5 S, 61.5 E, 235/61.5 DF; 318/601, 603, 600, 625, 632, 675; 89/41 TV, 41 B

[56] References Cited

UNITED STATES PATENTS

| | | | |
|---|---|---|---|
| 3,288,030 | 11/1966 | Lind | 235/61.5 D |
| 3,448,360 | 6/1969 | Pohl | 318/601 |
| 3,523,229 | 8/1970 | Black et al. | 318/601 |
| 3,575,085 | 4/1971 | McAdam | 235/61.5 |
| 3,685,159 | 8/1972 | Erhard | 235/61.5 S |
| 3,798,795 | 3/1974 | Michelsen | 89/41 TV |
| 3,845,276 | 10/1974 | Kendy et al. | 235/61.5 S |

*Primary Examiner*—Robert K. Schaefer
*Assistant Examiner*—John J. Feldhaus
*Attorney, Agent, or Firm*—Larson, Taylor and Hinds

[57] ABSTRACT

A digital electronic control system is provided for tracking a target and for directing an aiming system such as a gun. The control system comprises digital circuitry for determining the aiming angle required to aim the gun directly at the target and for determining an aiming angle correction which provides for leading the target by an amount such that a projectile fired by the gun will strike the target. The control system further includes a pair of motors controlled by the digital circuitry, one of which positions the gun to lead the target by a calculated aiming angle correction and the other of which positions, in a generic sense, the telescope an angular amount equal to the aiming angle correction behind the gun. In a preferred embodiment, an input is received by the control system from a tracking system which is positioned along with the gun and which can include, for example, a telescope which has an independently positionable optical axis.

7 Claims, 5 Drawing Figures

CONTROL SYSTEM FOR TRACKING A MOVING TARGET

CROSS-REFERENCE TO RELATED APPLICATIONS

This application is a continuation-in-part of an application by the same inventors, Ser. No. 337,572, filed Mar. 2, 1973, for a "Control System for Tracking a Moving Target", now U.S. Pat. No. 3,840,794.

BACKGROUND OF THE INVENTION

1. FIELD OF THE INVENTION

The present invention relates to a control system for tracking a moving object and for training a device to lead the object. In a particular adaptation, the present invention relates to a fire control system for optically tracking a moving object and for training a gun such that a projectile fired therefrom will hit the object.

2. DESCRIPTION OF THE PRIOR ART

Gun fire control systems operate, in general, by first determining the kinematic characteristics of a moving target, then calculating a firing offset angle displaced from a datum line, defined as the direct line of sight from the gun to the target and finally training the gun so as to lead the moving target by this offset angle. The kinematic characteristics of the target used by a fire control system include the target distance measured by the displacement tangential velocity or speed across the line of sight and the angular speed of the target relative to the gun. The speed across the line of sight is the speed vector component of the velocity of the target resolved in a direction perpendicular to the datum line.

The quantities required by a fire control system to calculate the firing offset angle include the ballistic parameters of the gun and the projectile fired therefrom. If the gun is mounted on a moving vehicle, such as a tank, the calculation of the firing offset angle also involves the speed and direction of the vehicle. The ballistic parameters of the projectile are used in combination with the target distance to calculate the travel time of the projectile to the target and ultimately to calculate the firing offset angle.

The target speed across the line of sight and the angular speed of the target vary with time. Consequently, it is advantageous to automatically and continuously determine the angular speed of the target and the firing offset angle. One method of obtaining the angular speed of the target is by visually following the target with a telescope and determining the angular speed of the telescope.

The particular method used in calculating and inserting the firing offset angle depends upon the specific fire control system. In many fire control systems, the firing axis of the gun, which in these systems is also the datum line, is normally kept parallel to the optical axis of the telescope. Hence, as the target is tracked with the telescope, the gun is also kept on the target. These systems use at least two methods for inserting corrections such as the firing offset angle. One method automatically offsets the telescope optical axis in a manner well known in the art to lag the target by an angle equal to the firing offset angle. The telescope operator, who has been tracking the target, then realigns the optical axis of the telescope onto the target image by operating the gun positioning mechanism, the telescope thereby also being realigned by an equal angular amount. Hence, the result is that the gun leads the target by the desired firing offset angle. The other method for inserting the firing offset angle uses a more sophisticated approach. In this method, the firing control system automatically offsets the firing axis of the gun, and hence the datum line, to lead the target by an angle equal to the calculated firing offset angle. The system simultaneously offsets the optical axis of the telescope to lag the datum line by an angle equal to the firing offset angle. Consequently, if the firing offset angle has been correctly calculated the optical axis of the telescope is exactly aligned to the target image.

Most of the fire control systems presently using the above methods utilize a computer for generating analog signals, that is, signals which vary continually with time. The analog signals are used to operate either electro-mechanical or electro-hydraulic servo systems for the gun and telescope. These fire control systems have proven to be complicated, overly delicate, and expensive. Furthermore, these systems are sensitive to variations in temperature which cause undesirable changes in the critical timed sequencing of the system components.

Other systems having sighting and aiming servo systems include laser beam systems used in the field of celestial telemetry. Because of the appreciable time required for the electromagnetic radiation to reach the distant celestial objects, it is necessary to accurately and smoothly offset the laser firing axis to a point ahead of the celestial object. Present sighting and aiming servo-systems usually do not provide either the requisite accuracy or the desired smoothness of operation.

SUMMARY OF THE INVENTION

The present invention overcomes these and other disadvantages of the prior art by providing a control system that uses digital electronic components to generate output signals which control the positionable aiming and sighting devices. The digital electronic components of the present invention are simple, accurate and drift free. Furthermore, the components are less expensive, less cumbersome and more rugged, and hence the components individually, and the system as a whole, are more reliable.

The present invention provides a digital electronic sighting and aiming control system for aiming a device at an object or at a moving target in accordance with the second, more sophisticated method mentioned above. The aimed device has a support, an aiming section rotatably mounted on the support and a sighting section having a movable sighting axis, the sighting section also mounted on the support and in one embodiment being rigidly mounted on and rotated by the aiming section. The sighting and aiming control apparatus comprises a digital electronic means for determining an aiming angle and an aiming angle correction. The digital electronic means controls a first means for positioning the aiming section to the aiming angle determined thereby and for varying the position of the aiming angle in the direction opposite to the direction of target motion by the aiming angle correction relative to the aiming angle. The digital electronic means further controls a second means for varying the position of the sighting axis of the sighting section by an angle equal to the aiming angle correction and in a direction opposite to the direction of target motion.

Other features and advantages of the present invention will be set forth in, or apparent from, the detailed description of a presently preferred embodiment thereof found hereinbelow.

DETAILED DESCRIPTION OF THE PREFERRED EMBODIMENTS

Figure 1:
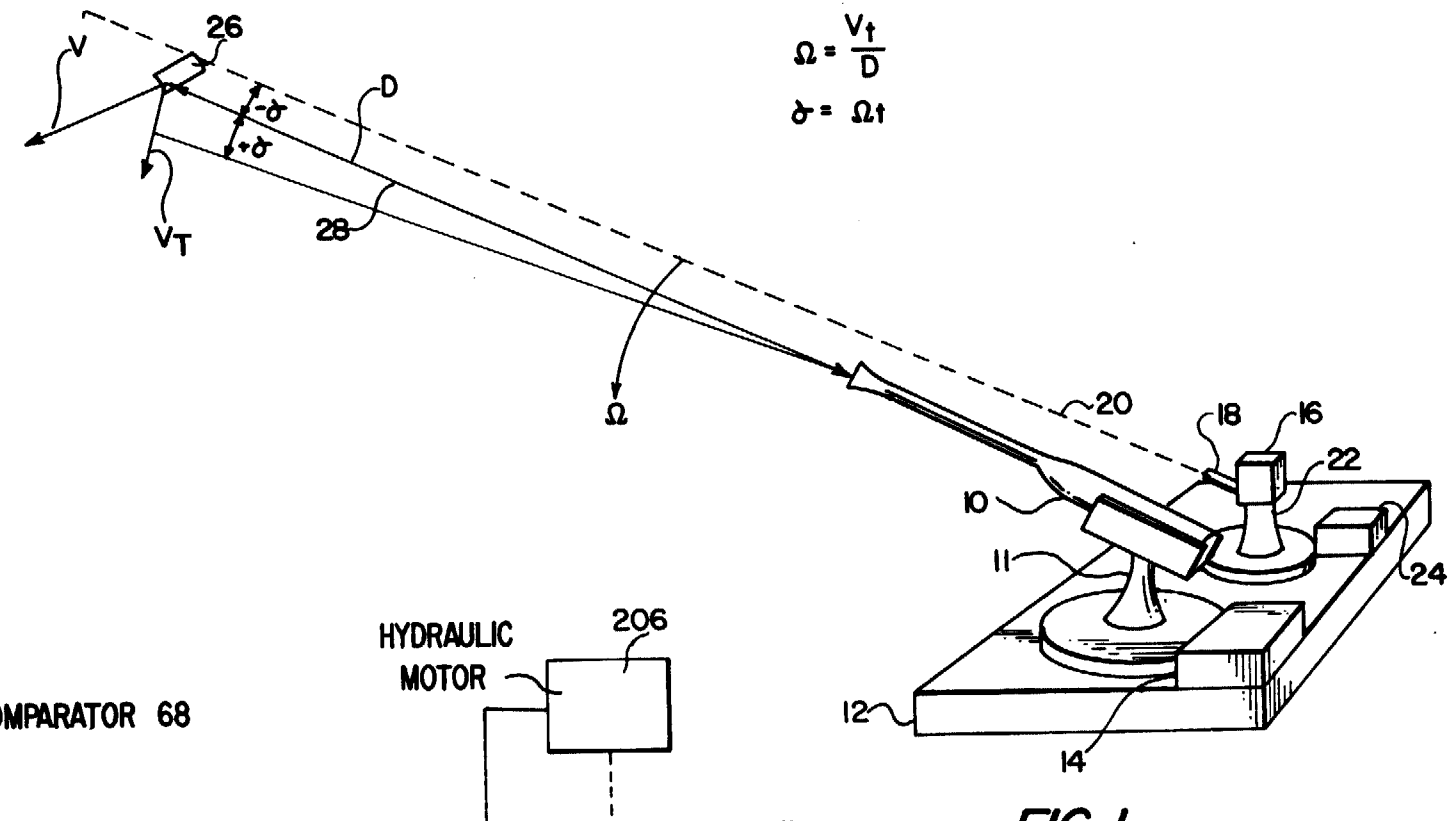
FIG. 1 is a highly schematic perspective view of a generic embodiment weapons system to be positioned by the present invention.

The preferred embodiment of the invention is described hereinbelow in relation to a gun fire control system. The gun fire control system could be one used in a tank equipped with a rotatable turret on which a gun is mounted. Referring to FIG. 1, there is shown in a generic embodiment of a weapons system positionable by the present invention, a gun 10 mounted on a turret 11 which is rotatably mounted on a support platform 12. A turret motor, schematically represented at 14, rotates turret 11 and hence, gun 10, in accordance with inputs signals from the fire control system. A sighting system 16 having a telescope 18 with an optical axis indicated by dashed line 20, is pivotably supported on a mounting 22. Mounting 22 is, in turn, rotatably mounted on support platform 12 and can be rotatably positioned independently of gun 10 by a motor schematically shown at 24.

Also shown in FIG. 1 is a part of the fire control geometry. The present invention positions gun 10 such that a projectile fired therefrom will strike a target 26 moving relative to gun 10. Target 26 is located a distance D from gun 10 in a direction indicated by line 28. Line 28 is often referred to as the line of sight. At a distance D, a projectile fired from gun 10 will take a time $t$ to reach target 26. If gun 10 were aimed in the same direction as the direction of the line of sight and a projectile were fired therefrom, after a time $t$ had elapsed, the projectile would arrive at the location where target 26 was when the projectile was fired. However, target 26, which is moving at a velocity V, would have moved a distance of Vt from that location and the projectile would miss the target. One function of a fire control system is to calculate an angle, called the lead angle or the aiming angle correction, to which gun 10 is positioned so that a projectile fired therefrom will hit target 26. In FIG. 1, the aimng angle correction has been denoted $\alpha$.

The velocity vector V of target 26 can be resolved into its component vectors, wherein the velocity component in a direction perpendicular to the line of sight, indicated by line 28, is denoted $V_T$. Vector $V_T$ is called the displacement tangential speed or the speed across the line of sight. The target angle displacement velocity, or simply the angular velocity of target 26 with respect to gun 10 is denoted $\Omega$ and can be calculated according to the formula $\Omega = V_T/D$. Consequently, in order for the projectile to hit target 26, it must be fired an angle of $\Omega t$ ° ahead of, or leading, target 26. This lead angle as mentioned above is denoted $\alpha$ and is referred to as the aiming angle correction.

In the present invention, the fire control system also uses the aiming angle correction to determine the position of sighting system 16. Simultaneously with the positioning of gun 10 to lead target 26, sighting system 16 is positioned as lag an imaginary line extending from the nozzle of gun 10, called the datum line, by an angle equal to the aiming angle correction. In FIG. 1 the datum line is the same as line of sight 28 because gun 10 is aimed directly at target 26. Thus, as shown in FIG. 1, optical axis 20 lags the datum line by the aiming angle correction $\alpha$.

In the operation of the fire control system shown in FIG. 1, target 26 is usually sighted through telescope 18 and is manually tracked by keeping optical axis 20 fixed on target 26. At some appropriate time, denoted hereinafter as time zero, the electronics of the fire control system are energized and gun 10 is appropriately positioned.

A principal function of the present invention, described hereinbelow, is to calculate the aiming angle correction $\alpha$, to generate digital signals for the positioning of gun 10, and the datum line associated therewith, an angular distance of $+\alpha$ ° leading target 26, and to generate digital signals for the positioning of optical axis 20 an angular distance of $-\alpha$ ° lagging or behind the datum line, used in proper aiming of gun 10. It should be noted, however, that for many practical systems the generated digital signals cannot be directly applied to operate motors 14 and 24. In general, the only motors presently available on the market which have the requisite power to rotate heavy support turrets, such as turret 11, require an analog input signal. Further in this regard, other applications of the present invention require motors which provide rapid accelerations to the device to be positioned and, again, generally speaking, the only motors available require an analog input signal. Consequently, in these embodiments, the digital outputs referred to above and coupled to a digital to analog (D/A) converter and the output of the converter is used to energize the motors such as motors 14 and 24. Alternatively, in those systems in which the present invention can be used which use digital stepping motors or other motors requiring a low driving power, the generated digital signals can be directly applied to the motors for the operation thereof.

Figure 2:
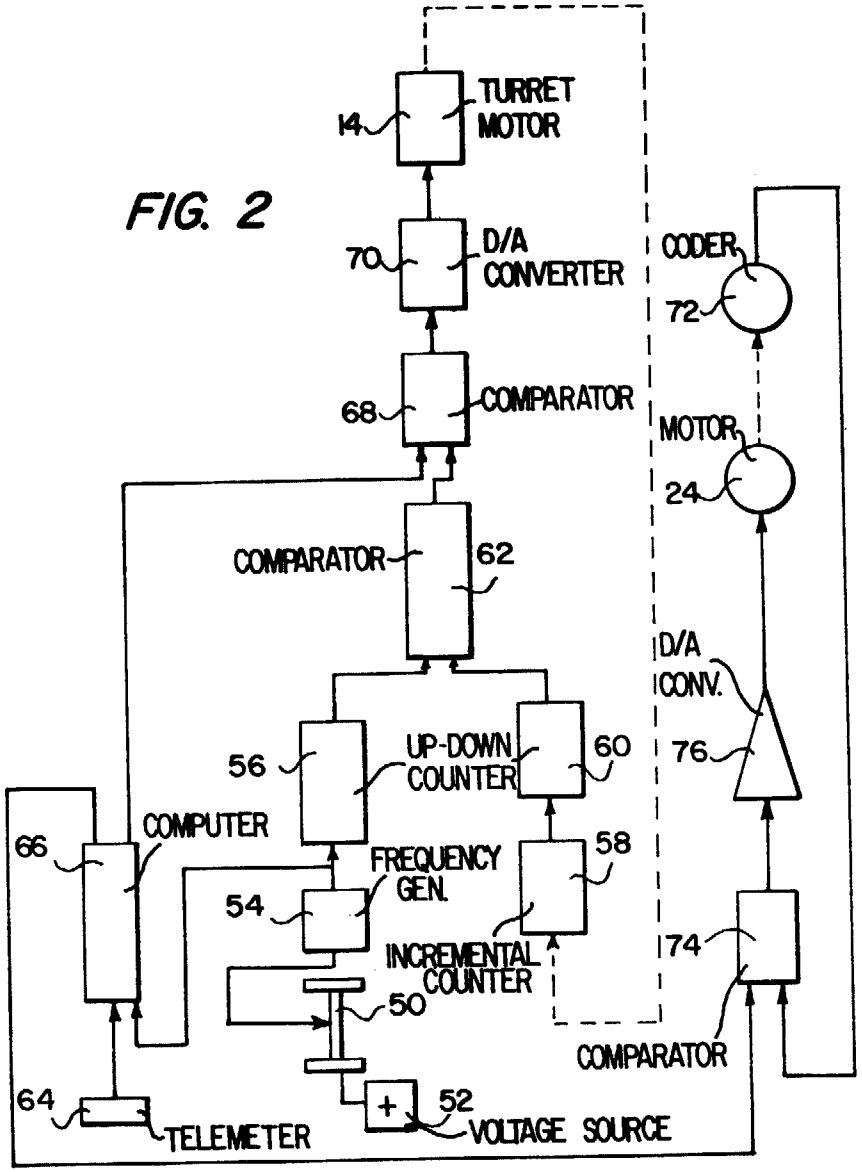
FIG. 2 is a block diagram of a fire control system in accordance with one embodiment of the present invention.

Referring to FIG. 2, there is shown a block diagram of the electronic circuitry of one embodiment of the invention. A potentiometer 50 is coupled to a manual tracking unit (not shown) associated with sighting system 16 (FIG. 1). Potentiometer 50 is connected to a suitable voltage source 52 and produces a voltage output in accordance with the angular rotation of the tracking unit. The output of potentiometer 50 is connected to the input of a frequency generator 54. Frequency generator 54 preferably comprises a voltage controlled oscillator and produces a pulse output having a frequency which varies with the applied voltage from potentiometer 50 and hence with the angular position of sighting system 16.

The pulses from frequency generator 54 are applied to a counter 56 which preferably comprises a so-called UP-DOWN counter. Counter 56 counts the input pulses thereto additively or subtractively, depending on the direction in which the tap of potentiometer 50 is being rotated, i.e., the pulse count registered by counter 56 will increase for rotation in one direction and decrease for rotation in the opposite direction. Each pulse counted by counter 56 represents, in digital form, target 26 an angular incremental displacement of sighting system 16 relative to the reference position on axis on support platform 12. Alternatively, the numerical value of the pulse count can represent the displacement of system 16 relative to a reference point on mounting 22 of a manually rotated sighting system. The number of pulses counted with respect to time units represents the angular velocity $\Omega$ of sighting system 16 and hence, of the tracked target 26.

Turret 11, of FIG. 1, is equipped with a device for generating a pulse for a predetermined amount of rotation of the turret. In the embodiment of the invention in FIG. 2, an incremental coder 58, is connected to and driven by turret motor 14, and provides a pulse for each $1/n$ th of a revolution of turret 11.

The pulsed digital output from incremental coder 58 is applied to a second counter 60. Counter 60 preferably comprises an UP-DOWN counter and, similarly to counter 56, counts the input pulses thereto either additively or subtractively depending upon the direction of rotation of turret 11. The numerical value of the pulse count represents the actual position of turret 11 relative to the aforementioned reference position.

The digital outputs from counter 56 and counter 60, are applied to an "adder-subtracter" or comparator 62. Comparator 62 generates a digital representation of the absolute angular value and of the sign (i.e., the direction) between the datum line of gun 10 and optical axis 20 of the telescope 18. When telescope 18 is trained on a target, and hence optical axis 20 is superimposed on the line of sight to the target, comparator 62 generates a signal corresponding to the angular offset between the datum line and the target position.

A telemeter system, represented by block 64, calculates the gun-to-target distance D. Telemeter system 64 can be coupled to sighting system 16 or can be independent thereof. An aiming angular correction processor or computer 66 calculates the aiming angle correction $\alpha$. The input signals to computer 66 include the digital output pulses generated by frequency generator 54. Computer 66 also receives a digital input signal representative of the gun-to-target distance D from telemeter 64 and internally calculates the travel time $t$ of a projectile to be fired from gun 10. The calculation of travel time $t$ requires using ballistic parameters which can be stored in computer 66 and using the gun-to-target distance D. Computer 66 calculates the instantaneous aiming angle correction, $\alpha$, by the multiplication of the instantaneous values of angular velocity $\Omega$ and projectile travel time $t$.

Computer 66 continuously transmits an output signal representative of the instantaneous value of the aiming angle correction $\alpha$ to a second adder-subtracter or comparator 68. Comparator 68 also receives the digital signal output from comparator 62 and algebraically adds the value of this signal to the value of the signal from computer 66. The absolute value of the resulting signal represents the difference between the desired angular position of gun 10 and its datum line and the present angular position of gun 10 and its datum line. The sign of the resulting signal represents the direction the gun 10 must be trained to properly lead the target.

The output of comparator 68, which is in digital form, is transmitted to a digital-to-analog (D/A) converter 70. D/A converter 70 generates an output signal of a voltage proportion to the pulse rate of the digital input signal thereto. The output of D/A converter 70 is applied to turret motor 14 which positions gun 10 in accordance therewith. In the embodiment of the invention shown in FIG. 2, turret motor 14 is preferably a direct current electric motor having a rotational speed proportional to the applied input voltage.

Simultaneously with the appropriate positioning of gun 10, sighting system 10 is positioned to lag the datum line associate with gun 10 by an angle equal to the aiming angle correction $\alpha$. As described above in connection with FIG. 1, mounting 22, which supports sighting system 16, is rotated by motor 24. In the present embodiment, motor 24 is preferably a direct-current motor. Motor 24 is appropriately energized so as to rotate sighting system 16 such that it lags the datum line of gun 10 by the firing angle correction $\alpha$.

A coder 72, coupled to motor 24, generates a digital output signal representative of the angular displacement of optical axis 20 from the aforementioned reference point. This signal is applied to an adder-subtracter or comparator 74. Comparator 24 also receives an input signal, the digital output signal from computer 66. Comparator 24 algebraically adds the two input signals and generates an output signal representative of the angular correction to be made to optical axis 20. The output signal is applied to a digital-to-analog (D/A) converter 76. Converter 76 converts the digital input signal to an analog voltage output signal. The output signal from A/D converter 76 is applied to motor 24, which the reupon positions sighting system 16 in accordance with the signal.

Figure 5:
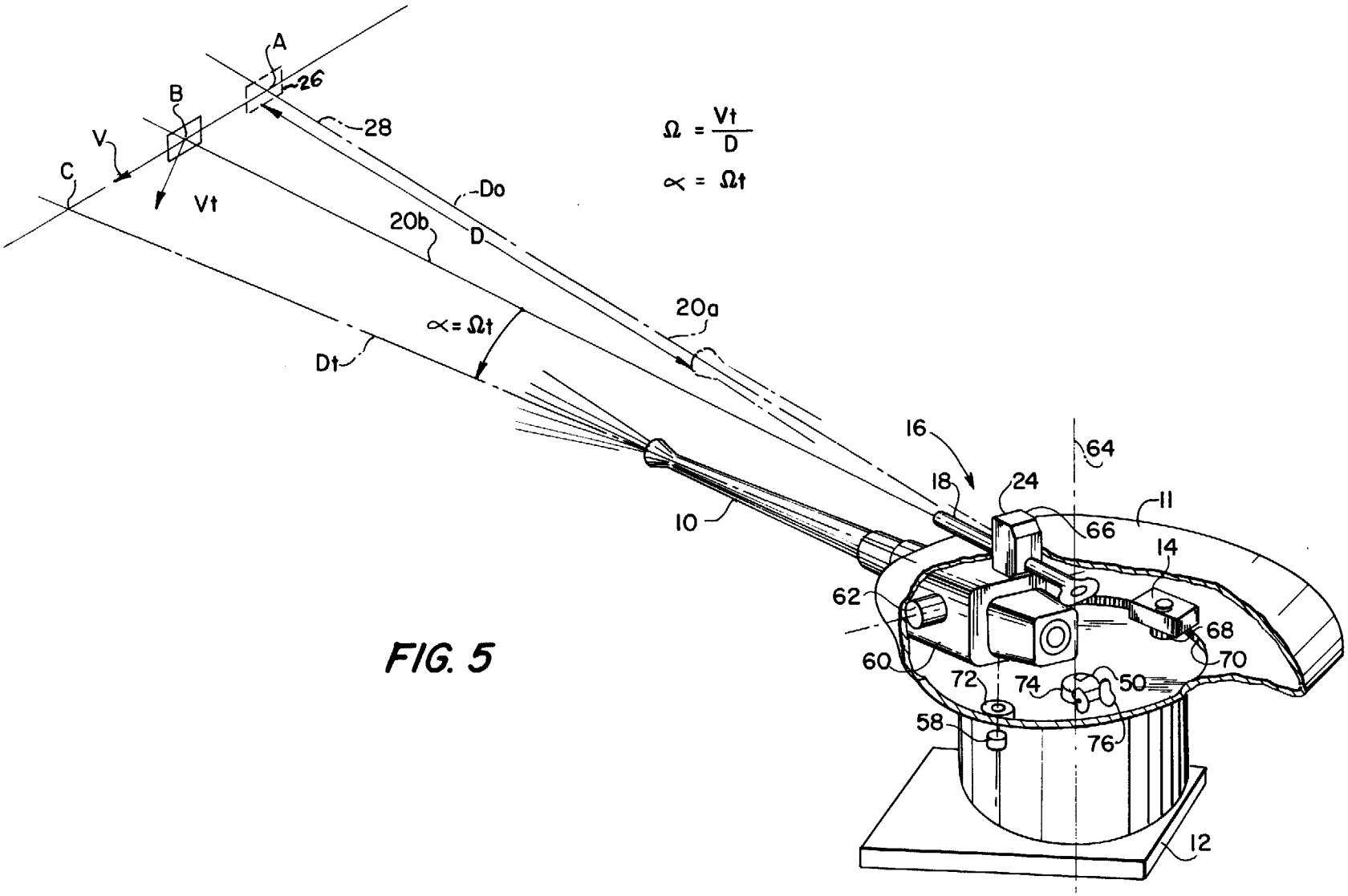
FIG. 5 is a schematic perspective view of a specific embodiment of a weapons system to be positioned by the present invention.

A specific embodiment of a weapon system positionable by the present invention is shown in FIG. 5. Gun 10 is mounted on turret 11 which is rotatably mounted on support platform 12. Support platform 12 can be, for example, the body of a tank. Gun 10 has a cradle 60 pivotably mounted on a horizontally disposed axle 62, which in turn, is mounted on turret 11. Turret 11 is rotatable about a vertical axis 64.

Telescope 18 is mounted in a case 66, which in turn is rigidly mounted on top of cradle 60. Thus when cradle 60 is rotated, case 66, and hence telescope 18, is rotated with it. Case 66 can also contain the following elements shown in FIG. 2: telemeter 64, comparator 66, comparator 74, digital to analog converter 76, motor 24 for controlling the movement of the cross hairs or the mounting of the optical axis (depending on the type of telescope used) as described further hereinbelow, and coder 72.

Mounted on turret 11 is turret driving motor 14 for driving a pinion 68 which meshes with and drives a circular toothed rack 70 which is rigidly mounted with respect to support platform 12. Incremental coder 58 is fastened on turret 11 and is driven by a pinion 72 which meshes with toothed rack 70.

A manual tracking unit 74 is fastened to turret 11 and comprises a double grip device 76, a first potentiometer for generating a voltage corresponding to the rotation of device 76 about a horizontal axis, and a second potentiometer for generating an output voltage which corresponds to the rotational position of device 76 about a vertical axis. The second potentiometer is shown in FIG. 2 as potentiometer 50 and whose output is used for controlling the speed and direction of rotation of turret driving motor 14 for rotationally driving turret 11. In a similar manner, but for the sake of simplicity has not been shown, the electrical output from the first potentiometer can be used for vertically positioning cradle 60 of gun 10.

Operation of the weapon system shown in FIG. 5 is as follows. In a first stage, a gunner operating the weapon system and who has been following the motion of the target through the telescope, presses a take over switch, thereby establishing a zero time reference. When the take over switch is thrown, the device automatically shifts, by a calculated value, the sighting axis of the telescope in relation to the axis of the gun. Therefore the gunner will suddenly see the image of the target leave the cross hairs. In a second stage, the gunner causes re-alignment of the cross hairs on the target by actuating the target rotation control (assuming an azimuth correction is to be made). Because the telescope is fixedly mounted on the cradle, the sighting axis follows the movement of the cradle and when the gunner has re-established the cross hairs on the target, the firing axis has been positioned ahead of the target by the required angular correction. This result is obtained by the system automatically shifting the turret in relation to the target by the desired correction angle and, at the same time, shifting the sighting axis an angle equal to and opposite the correction applied to the cradle.

This operation can be readily understood by referring to the fire control diagram associated with FIG. 5. A target moving relative to the fire control system has previously been selected and is being tracked, during which time the firing axis of gun 10 and the sighting axis 20 of telescope 18 are colinear. At some zero reference time, the gunner energizes the system. In FIG. 5, at the zero reference time, sighting axis 20 is at 20*a* and is merged with the firing axis Do of gun 10, both axes being aligned on the target which is at position A. At a later instant of time "T" (where T is the time necessary for calculating and introducing the correction into the system), the gun is fired. The sighting axis 20 of the telescope is now at 20*b* still in alignment with the target, which during the time T has moved from position A to position B. However, the firing axis of gun 10 has in the same period of time T been moved to D*t* and is aiming at position C, gun 10 having been shifted in advance of the target by an angle $\alpha = \Omega t$ (where $t$ is the time of flight of the projectile to reach the target as discussed above). Hence, both the target and the projectile will arrive at position C at the same instant, but the sighting axis 20 will not have moved off the target 26 when gun 10 was shifted.

The embodiment of the invention as shown in FIG. 2 has been described hereinabove in terms of calculating and adjusting only the bearing angle of gun 10. It will be appreciated by those skilled in the art that the same principles can be applied to calculating and adjusting other parameters in the fire control problem, such as the elevation angle of gun 10. Naturally, the formula necessary for the calculation of time $t$, the time required for a projectile fired from gun 10 to reach target 26, is changed when the other parameters are used. However, the calculation of time $t$ is well known in the art and further elucidation of the calculation is not required herein.

The digital firing control system described hereinabove provides a high degree of accuracy, yet it is completely adaptable to be used with motors operated by analog signals. The most critical input in the present system is a digital signal representing the deviation from the reference points. Any errors introduced into the system from the digital-to-analog conversion or the operation of the electrical motors with analog signals can be easily corrected by position feedback signals. Consequently the present invention can still provide the accuracy inherent in a totally digital system.

Figure 3:
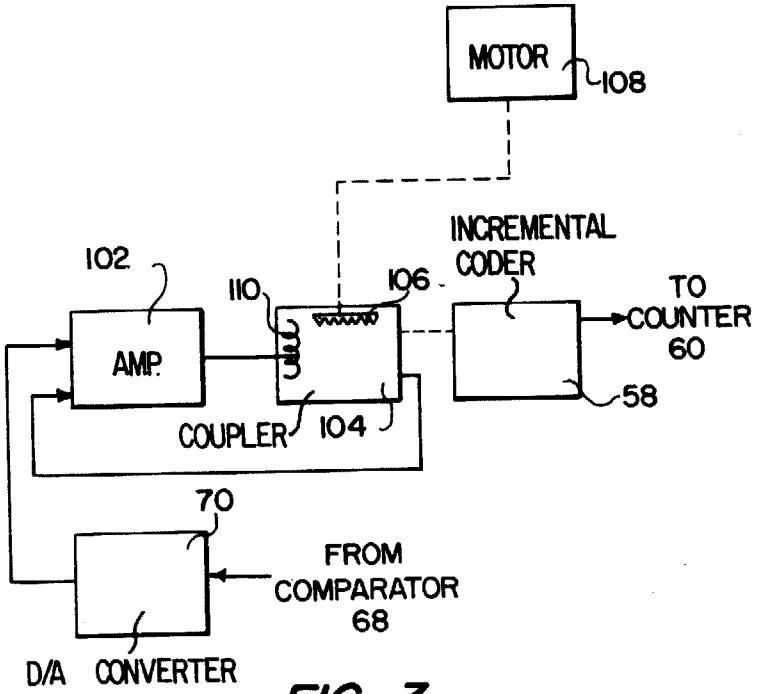
FIG. 3 is a schematic block diagram of an alternate embodiment of a portion of the invention shown in FIG. 2.

A second embodiment of the invention is shown in FIG. 3. Up to and including D/A converter 70, the embodiment of the invention shown in FIG. 3 is the same as that shown in FIG. 2. However, the output of D/A converter 70 in this embodiment is applied to an operational amplifier 102 connected as a double input integral adder. Amplifier 102 produces an output voltage proportional to the sum of the voltage generated by D/A converter 70 and a voltage generated by a coupler 104 and applied in a feedback loop. Coupler 104 has a primary winding 106, driven at a constant speed by an electric motor 108, and an energizing winding 110, energized by the voltage generated by amplifier 102. Coupler 104 produces a torque that is proportional to the current delivered to its energizing winding 110 and drives both turret 11 (FIG. 1) and incremental coder 58.

Figure 4:
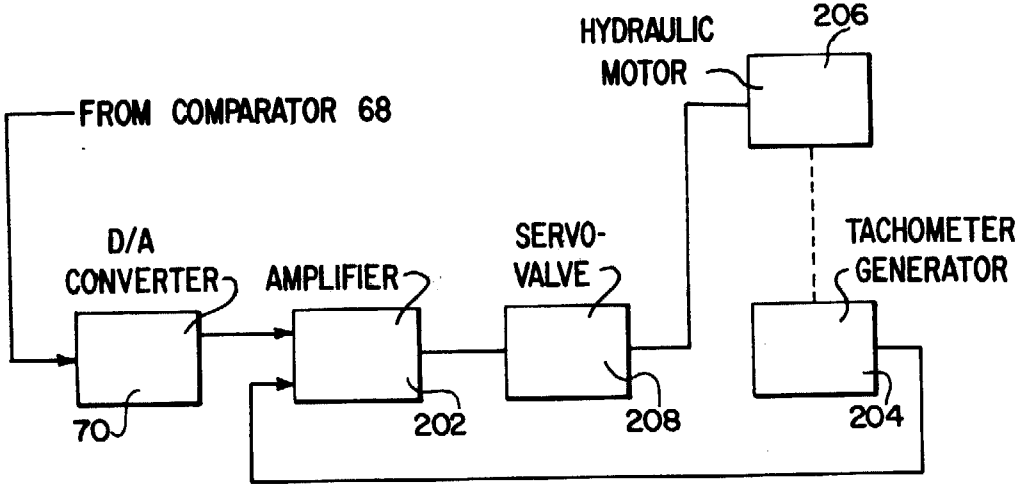
FIG. 4 is a schematic block diagram of a further embodiment of the same portion of the system of FIG. 2.

A third embodiment of the invention is shown in FIG. 4. As in FIG. 3, this embodiment is the same as that shown in FIG. 2 up to and including D/A converter 70. The output of D/A converter 70 is applied to an operational amplifier 202 connected as a double input integral adder. Amplifier 202 produces an output voltage which is proportional to the sum of the voltage generated by D/A converter 70 and a voltage generated by a tachometer-generator 204. Tachometer-generator 204 is driven by a hydraulic motor 206 and generates a voltage proportional to the rotational speed at which it is driven. The output voltage from amplifier 202 is applied to a servo-valve coil 208. Servo-valve coil 208 is coupled to motor 206 and controls the output torque of motor 206 in accordance with the magnitude of the voltage output of amplifier 202.

Further variations of the invention will be obvious to those of ordinary skill in the art. An example of such a variation is the substitution of a pulse current control for the voltage control of turret motor 14, whereby the current pulse width is proportional to the output signal from comparator 68. Coupler 104 or servo-control valve 208 in FIGS. 3 and 4, respectively, can be similarly controlled. Another such variation is the substitution of an absolute coder for incremental coder 58 and counter 60 in FIG. 2. Such an absolute coder would continuously provide a signal representative of the position of gun 10 relative to the reference point.

Furthermore, as will be obvious to one skilled in the art, the present invention has applications other than with a turret mounted gun fire control system. These applications can include any system which has to be aimed from either a moving support or from a stationary installation. Thus, the invention can be adapted to a missile fire control system for properly positioning the missile launching ramp or can be adapted to a celestial laser telemetry system for properly positioning the laser so that laser pulses emitted therefrom will intercept a celestial body.

The present invention can also be applied to telescopic sighting systems. Because telescopes have a very narrow field of vision, they are often equipped with an auxiliary wide angle sight-tube for locating the object to be observed, such as a star. Thus the present invention can be used to offset the optical axis of the telescope relative to the optical axis of the auxiliary sight-tube so as to enable a shift from a star presently being observed to the next star to be observed.

It should be apparent that in the alternative uses of the invention, the angular velocity $\Omega$ of the object and the value of the travel time $t$ required for an object to reach the target may be obtained from different sources. For example, in celestial laser telemetry, where the "projectiles" fired at the celestial body are laser pulses, the value of travel time $t$ can be obtained from mathematical data processed by a previously programmed computer.

Although the invention has been described in detail with respect to exemplary embodiments thereof, it will be understood by those of ordinary skill in the art that other variations and modifications may be effected in these embodiments within the scope and spirit of the invention.

We claim:

1. Sighting and aiming control apparatus for automatically positioning a system for tracking a moving object, the tracking system including a support, an aiming section rotatably mounted on the support, and a sighting section, having a movable sighting axis, said sighting section being rigidly mounted on and rotated with said aiming section, said sighting and aiming control apparatus comprising a digital electronic means for determing an aiming angle and an aiming angle correction including a frequency generator for producing a pulse output corresponding to the relative angular position of the object; first means controlled by said digital electronic means for positioning the aiming section to the aiming angle determined by said digital electronic means and for varying the position of the aiming section by the aiming angle correction relative to said aiming angle in the direction of the target motion; second means controlled by said digital electronic means for varying the position of the sighting axis of the sighting system by an angle equal to the aiming angle correction in a direction opposite to the direction of the target motion; third means for producing a pulse output corresponding to the angular position of the aiming section; fourth means for comparing the pulse output produced by said frequency generator and said third means and for producing a digital output corresponding to the comparison; fifth means for generating a digital output representative of the desired aiming angle correction; sixth means for comparing the outputs of said fourth means and said fifth means and for applying a signal corresponding to said comparison to said first means for the control thereof; and seventh means for applying said digital output of said fifth means to control said second means.

2. Sighting and aiming control apparatus as claimed in claim 1, wherein said fourth means comprises counter means for adding or subtracting said pulses generated by said frequency generator depending on the direction of the movement of the object and for adding or subtracting said pulses generated by said third means depending upon the position of the aiming section, said fourth means producing a digital output corresponding to the algebraic summation of said counter means and being representative of the desired aiming angle; and wherein said sixth means algebracially adds the digital output from said fifth means and said fourth means and produces a digital output which is representative of the desired correction to be made to the angular position of the aiming section.

3. Sighting and aiming control apparatus as claimed in claim 2 wherein said fourth means includes a first counter connected to the output of said frequency generator for counting the pulses produced thereby additively or subtractively depending upon the direction of movement of the sighting axis; a second counter connected to the output of said third means for counting the pulses produced thereby additively or substractively depending upon the angular position of the aiming section of said count; and a comparator connected to said first counter and said second counter for algebraically comparing the contents thereof and for producing a digital signal representative of the comparison; and wherein said sixth means comprises a comparator.

4. Sighting and aiming control apparatus as claimed in claim 3 wherein said fifth means is connected to the output of said frequency generator and comprises a computer for calculating travel time of a projectile fixed from the aiming section to the tracked object, for calculating the relative angular speed of the object and for generating a digital output corresponding to the product of the relative angular speed and the travel time.

5. Sighting and aiming control apparatus as claimed in claim 1 wherein said frequency generator produces a pulse output corresponding to the position of the sighting axis, the sighting axis being positioned to track the object.

6. Sighting and aiming control apparatus as claimed in claim 5 and further including a potentiometer coupled to the sighting section for producing a voltage which varies with the angular position of the sighting axis; and wherein said frequency generator is connected to the output of said potentiometer and generates a pulse output having a frequency corresponding to the voltage produced by said potentiometer.

7. Sighting and aiming control apparatus as claimed in claim 1 and further including an operational amplifier connected as a double input adder-subtracter, an input of said amplifier being coupled to the output of said sixth means; a synchronous means coupled to said amplifier and controlling the bearing of the sighting axis in accordance with the output of said amplifier; and a coder driven by said synchronous means for producing digital pulses in accordance with the angular position of said synchronous means, said coder being coupled to the input of said amplifier.

* * * * *